US007032772B2

(12) United States Patent
McCaslin

(10) Patent No.: US 7,032,772 B2
(45) Date of Patent: Apr. 25, 2006

(54) LAP TOP TRAY

(76) Inventor: Samuel C. McCaslin, 3137 Woodridge Dr., Pittsburgh, PA (US) 15227

( * ) Notice: Subject to any disclaimer, the term of this patent is extended or adjusted under 35 U.S.C. 154(b) by 156 days.

(21) Appl. No.: 10/613,243

(22) Filed: Jul. 3, 2003

(65) Prior Publication Data

US 2005/0040176 A1 Feb. 24, 2005

(51) Int. Cl.
*B65D 25/00* (2006.01)

(52) U.S. Cl. ..... 220/737; 220/574

(58) Field of Classification Search ..... 220/574, 220/737; 215/252, 901; 248/311.2
See application file for complete search history.

(56) References Cited

U.S. PATENT DOCUMENTS 2,777,626 A * 1/1957 French ..... 229/406
4,418,828 A * 12/1983 Wilde et al. ..... 215/252
5,119,967 A * 6/1992 Ercolani ..... 220/23.6
5,170,980 A * 12/1992 Burrows et al. ..... 248/311.2
5,607,077 A * 3/1997 Torkelson ..... 220/575
6,305,532 B1 * 10/2001 Overkamp ..... 206/217
6,371,322 B1 * 4/2002 Bryant ..... 220/23.86
6,766,916 B1 * 7/2004 Ma ..... 215/252
2002/0134903 A1 * 9/2002 Lin ..... 248/346.11

* cited by examiner

*Primary Examiner*—Jes F. Pascua
*Assistant Examiner*—Harry Grosso
(74) *Attorney, Agent, or Firm*—James Ray & Assoc.

(57) ABSTRACT

An apparatus useful as at least one of a table place mat and a lap top tray which prevents tipping of a specially configured fluid container includes a first member having a predetermined shape and a second member disposed at least one of within and on an upper surface of such first member at a predetermined location for both retaining and preventing tipping of such specially configured fluid container.

14 Claims, 4 Drawing Sheets

LAP TOP TRAY

CROSS-REFERENCE TO RELATED APPLICATIONS

The invention taught in this patent application is closely related to the following co-pending U.S. patent application, "Cup Holder". This co-pending application Ser. No. 10/437,817, was filed on May 14, 2003. Further, the teachings of the above mentioned application are incorporated herein by reference hereto.

FIELD OF THE INVENTION

The present invention relates in general to a tray, and more specifically the present invention relates to a tray in which a fluid container and a food container are secured in the tray and prevented from tipping over.

BACKGROUND OF THE INVENTION

Trays to carry food and drink have been in use for a number of years. The majority of prior art trays offer a flat, smooth surface on which to place food and drink. Sliding, tipping, and spilling of the food and drink placed on the prior art trays is common, and not desired. More recent prior art trays offer a drink holder combined with the tray. These drink holders are recesses in the tray into which a drink may be placed, preventing it from sliding along the surface of the tray, but still allowing possibility of the drink to fall off the tray. It is desirable to have a tray where a drink container and a food container are prevented from tipping on the tray or falling off the tray. No prior art inventions which applicant is aware of offer this ability.

SUMMARY OF THE INVENTION

In one aspect, the invention generally provides an apparatus useful as at least one of a table place mat and a lap top tray which prevents tipping of a specially configured fluid container. Such apparatus includes a first member having a predetermined shape and a second member disposed at least one of within and on an upper surface of such first member at a predetermined location for both retaining and preventing tipping of such specially configured fluid container.

In another aspect, the invention generally provides a specially configured fluid container for use with at least one of a table place mat and a lap top tray including a device to prevent tipping of such specially configured fluid container disposed at least one of within and on an upper surface of such at least one of the table place mat and the lap top tray having a first plurality of gear like members on one of an inner surface and an outer surface of such device for both retaining and preventing tipping of such specially configured fluid container. The specially configured fluid container includes a fluid container. Such fluid container further includes a second plurality of gear like members disposed on such fluid container.

The second plurality of gear like members disposed on an opposite one of an outer surface and an inner surface of such device for both retaining and prevent tipping of said fluid container. Such second plurality of gear like members having a substantially identical pitch as the first plurality of gear like members for engagement with such first plurality of gear like members.

In still another aspect, the invention generally provides an apparatus useful as at least one of a table place mat and a lap top tray which prevents tipping of a specially configured fluid container and a specially configured food container, such at least one of the table place mat and the lap top tray includes a first member having a predetermined shape. There is a second member disposed at least one of within and on an upper surface of the first member at a first predetermined location for both retaining and preventing tipping of the specially configured fluid container. Included is a third member disposed at least one of within and on an upper surface of the first member at a second predetermined location for both retaining and preventing tipping of such specially configured food container.

OBJECTS OF THE INVENTION

It is, therefore, one of the primary objects of the present invention to provide an apparatus to prevent tipping of a specially configured fluid container.

Another object of the present invention is to provide a means for securing a cup or glass to a tray.

Yet another object of the present invention is to provide a specially configured fluid container.

Still a further object of present invention is to provide a specially configured food container.

In addition to the above-described objects and advantages of the lap top tray, various other objects and advantages of the present invention will become more readily apparent to persons who are skilled in the same and related arts from the following more detailed description of the invention, particularly, when such description is taken in conjunction with the attached drawing figures and the appended claims.

DETAILED DESCRIPTION OF THE PRESENTLY PREFERRED EMBODIMENT

Figure 1:
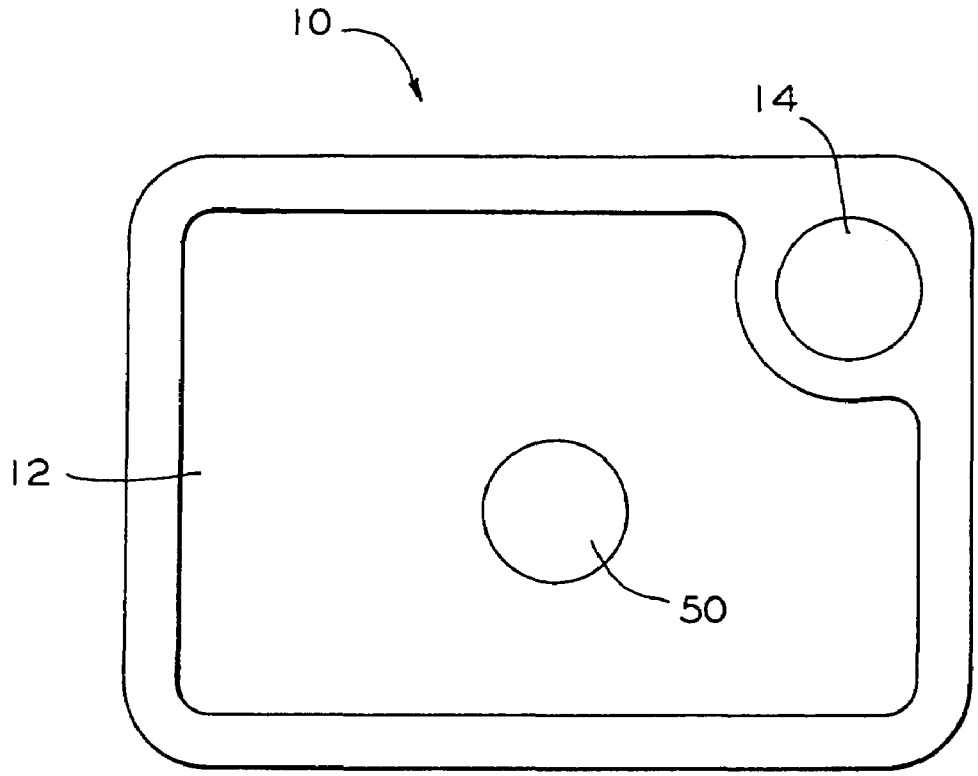
FIG. 1 is a top view of an apparatus useful as at least one of a table place mat and lap top tray.
Figure 2:
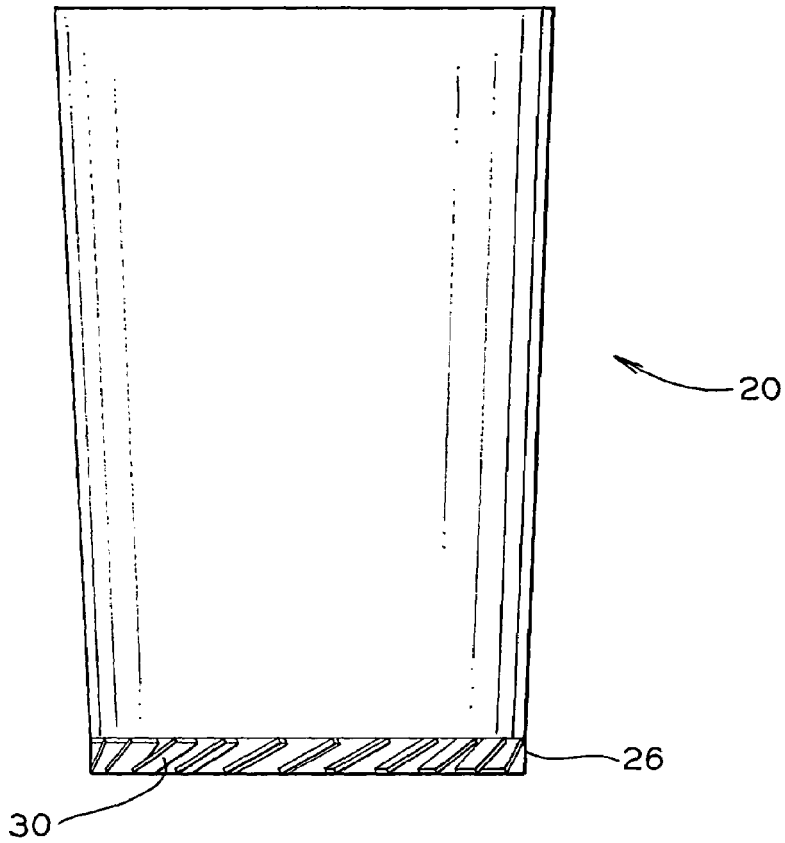
FIG. 2 is a side view of a specially configured fluid container for use with an apparatus useful as at least one of a table place mat and lap top tray.
Figure 3:
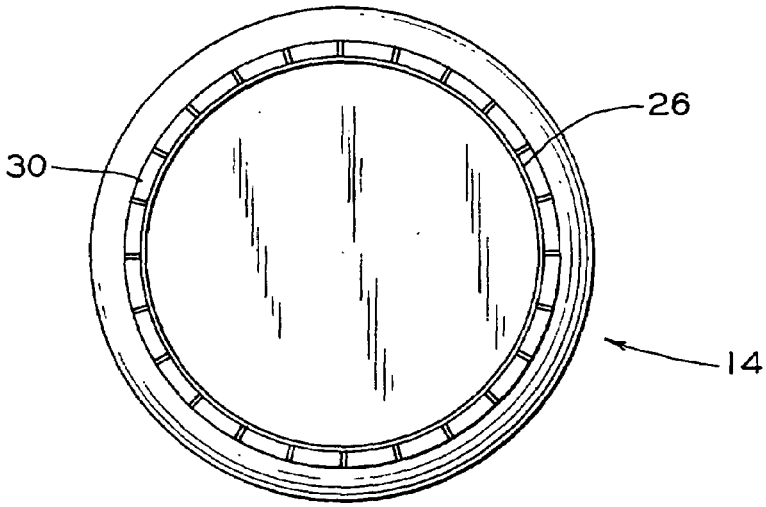
FIG. 3 is a bottom view of a specially configured fluid container for use with an apparatus useful as at least one of a table place mat and lap top tray.
Figure 4:
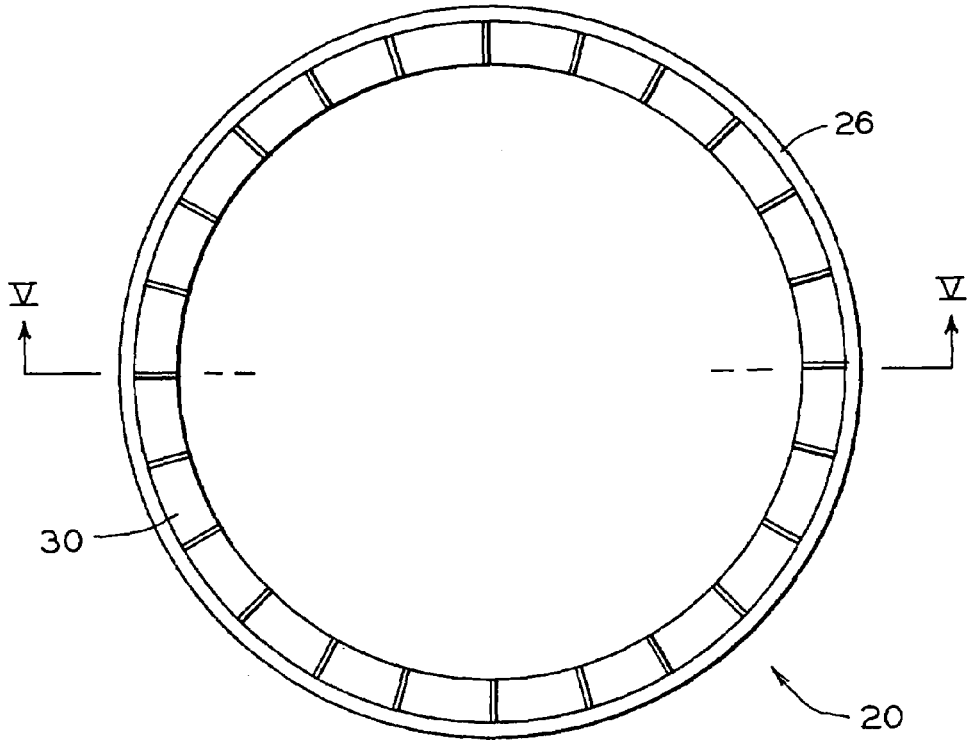
FIG. 4 is a top view of a ring like member having a predetermined plurality of gears disposed thereon.
Figure 5:
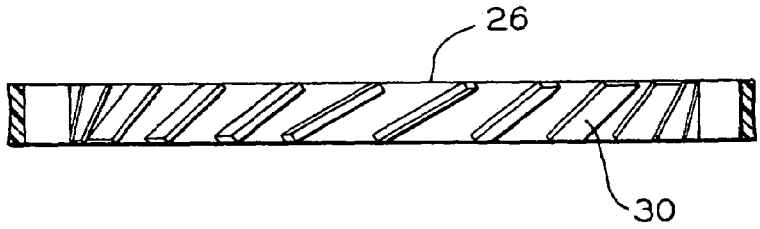
FIG. 5 is a cross-sectional view of a ring like member having a predetermined plurality of gears disposed thereon.

Prior to proceeding to a much more detailed description of the present invention, it should be noted that identical components which have identical functions have been identified with identical reference numerals throughout the several views illustrated in the drawing figures for the sake of clarity and understanding of the invention.

Referring initially to FIG. 1 an apparatus useful as at least one of a table place mat and lap top tray constructed according to a presently preferred embodiment of the invention is generally indicated by reference numeral 10. The apparatus 10 useful as at least one of a table place mat and a lap top tray prevents tipping of a specially configured fluid container 20. Such apparatus includes a first member 12 having a predetermined shape, and a second member 14 disposed at least one of within and on an upper surface of the first member 12 at a predetermined location. Such second member 14 both retains and prevents tipping of such specially configured fluid container 20.

In a presently preferred embodiment, such predetermined shape of the first member 12 is generally rectangular, and such predetermined location of the second member 14 is adjacent at least one outer edge of the first member 12. The first member 12 and second member 14 are made of one of polyethylene, polypropylene, polyester and polyvinyl chloride. In a presently preferred embodiment the first member 12 and second member 14 are made of polyvinyl chloride. The first member 12 further includes a non-skid surface on at least one of a first side 16 and a second side 18 of such first member 12, and the first member 12 may include a non-skid surface on each of a first side 16 and a second side 18 thereof.

Figure 6:
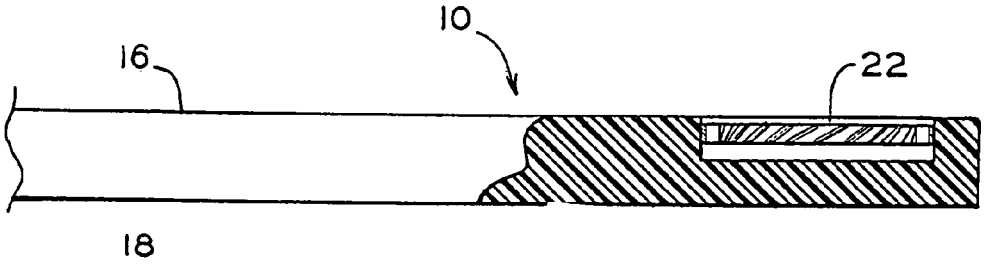
FIG. 6 is a cross-sectional view of an embodiment of the apparatus useful as a lap top tray.
Figure 7:
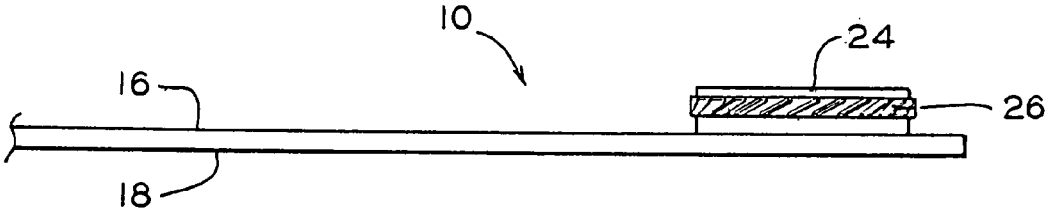
FIG. 7 is a cross-sectional view of an embodiment of the apparatus useful as a table place mat.
Figure 8:
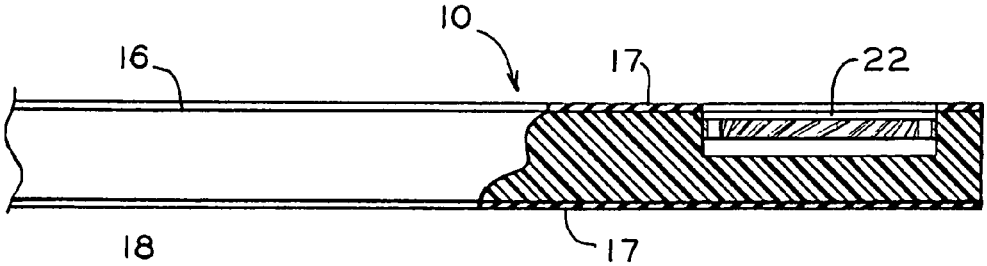
FIG. 8 is a cross sectional view of an embodiment of the apparatus useful as a lap top tray showing a non skid surface on both sides of the apparatus.
Figure 9:
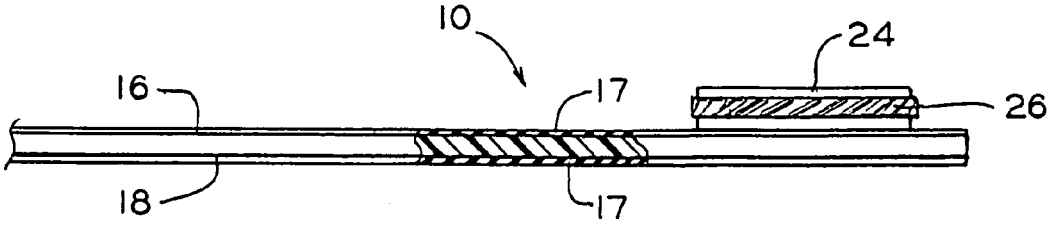
FIG. 9 is a cross-sectional view of an embodiment of the apparatus useful as a table place mat showing a non skid surface on both sides of the apparatus.

Illustrated in FIGS. 6 and 7 is a cross-sectional view of an embodiment of the apparatus useful as a lap top tray and as a place mat, respectively. Illustrated in FIGS. 8 and 9 are the cross sectional views of a lap top tray and a place mat that are shown in FIGS. 6 and 7. In this embodiment the non skid surface 17 is shown on such first side 16 and such second side 18 of the lap top tray and the place mat.

The second member 14 includes at least one of a cavity 22 disposed in such first member and an annular projection 24 disposed on such first member 12. The cavity 22 further includes a ring like member 26 disposed therein having each of a predetermined diameter, a predetermined thickness and a predetermined height. The annular projection 24 further includes a ring like member 27 disposed thereon having each of a predetermined diameter, a predetermined thickness and a predetermined height. The predetermined height of such a ring like members 26 and 27 is between about ⅛ inch and about ½ inch, and a predetermined thickness of such ring like members 26 and 27 is between about ⅛ inch and about ½ inch. In an alternative embodiment, the predetermined diameter is an adjustable diameter.

The second member 14 further includes a first plurality of gear like members 30 secured to one of an inner surface and an outer surface of such second member 14, depending on whether the second member is a cavity 22 or an annular projection 24. This first plurality of gear like members 30 has a first predetermined pitch for engagement with a second plurality of gear like members 30 having a substantially identical pitch as the first plurality of gear like members 30 and are disposed on an opposite one of an outer surface and an inner surface of a predetermined portion of such specially configured fluid container 20. If the first member 12 includes a cavity 22 disposed in it, then the second member 14 would have gear like members 30 secured to an inner surface. Conversely, if the first member 12 includes an annular projection 24 disposed on it, then the second member 14 would have gear like members 30 secured to an outer surface. Each of the first gear like members 30 and the second gear like members 30 are disposed at an angle of between about 20 degrees and about 65 degrees from a horizontal plane. In a presently preferred embodiment, each of the first gear like members 30 and the second gear like members 30 are disposed at an angle of between about 25 degrees and about 35 degrees from a horizontal plane.

The ring like member 26 further includes a means 28 disposed on an outer surface of the ring like member 26 to prevent slipping, and this outer surface is one of a bottom surface and a vertical surface of such ring like member 26. In a presently preferred embodiment, the outer surface is a bottom surface.

The present invention further includes a specially configured fluid container 20 for use with an apparatus 10 useful as at least one of a table place mat and a lap top tray including a device 14 to prevent tipping of such specially configured fluid container 20. Such device 14 is disposed at least one of within and on an upper surface of such apparatus 10 and has a first plurality of gear like members 30 on one of an inner surface and an outer surface of such device 14 for both retaining and preventing tipping of such specially configured fluid container 20. The specially configured fluid container 20 is comprised of a fluid container 20 and a second plurality of gear like members 30 disposed on such fluid container 20, such second plurality of gear like members 30 disposed on an opposite one of an outer surface and an inner surface of such device 14 for both retaining and prevent tipping of a fluid container, the second plurality of gear like members 30 having a substantially identical pitch as such first plurality of gear like members 30 for engagement with the first plurality of gear like members 30. The fluid container 20 is made of one of polyethylene, polypropylene, polyester and polyvinyl chloride. In presently preferred embodiment, the fluid container is made of polyvinyl chloride.

In an alternate embodiment, there is an apparatus 10 useful as at least one of a table place mat and a lap top tray which prevents tipping of a specially configured fluid container 20 and a specially configured food container 40. Such apparatus 10 is comprised of a first member 12 having a predetermined shape and a second member 14 disposed at least one of within and on an upper surface of such first member 12 at a first predetermined location for both retaining and preventing tipping of such specially configured fluid container 20 and a third member 50 disposed at least one of within and on an upper surface of the first member 12 at a second predetermined location for both retaining and preventing tipping of such specially configured food container 40. The specially configured food container 40 is at least one of a plate and a bowl.

While the present invention has been described by way of a detailed description of a particularly preferred embodiment, it will be readily apparent to those of ordinary skill in the art that various substitutions of equivalents may be affected without departing from the spirit or scope of the inventions set forth in the appended claims.

I claim:

1. An apparatus useful as at least one of a table place mat and a lap top tray which prevents tipping of a specially configured fluid container, said at least one of a table place mat and lap top tray comprising:

(a) a first member having a predetermined shape; and (b) a second member disposed at least one of within and on an upper surface of said first member at a predetermined location for both retaining and preventing tipping of such specially configured fluid container, said second member further includes a first plurality of gear like members secured to one of an inner surface and an outer surface of said second member, said first plurality of gear like members having a first predetermined pitch for engagement with a second plurality of gear like members having a substantially identical pitch as said first plurality of gear like members and disposed on an opposite one of an outer surface and an inner surface of a predetermined portion of such specially configured fluid container.

2. An apparatus useful as at least one of a table place mat and a lap top tray which prevents tipping of a specially configured fluid container, according to claim 1, wherein said predetermined shape is generally rectangular.

3. An apparatus useful as at least one of a table place mat and a lap top tray which prevents tipping of a specially configured fluid container, according to claim 1, wherein said predetermined location is adjacent at least one outer edge of said first member.

4. An apparatus useful as at least one of a table place mat and a lap top tray which prevents tipping of a specially configured fluid container, according to claim 1, wherein said first member includes a non-skid surface on at least one of a first side and a second side of said first member.

5. An apparatus useful as at least one of a table place mat and a lap top tray which prevents tipping of a specially configured fluid container, according to claim 4, wherein said first member includes a nonskid surface on each of said first side and said second side of said first member.

6. An apparatus useful as at least one of a table place mat and a lap top tray which prevents tipping of a specially configured fluid container, according to claim 1, wherein said second member includes a cavity disposed in said first member.

7. An apparatus useful as at least one of a table place mat and a lap top tray which prevents tipping of a specially configured fluid container, according to claim 6, wherein said cavity further includes a ring like member disposed therein having each of a predetermined diameter, a predetermined thickness and a predetermined height.

8. An apparatus useful as at least one of a table place mat and a lap top tray which prevents tipping of a specially configured fluid container, according to claim 7, wherein said predetermined height of said ring like member is between about ⅛ inch and about ½ inch.

9. An apparatus useful as at least one of a table place mat and a lap top tray which prevents tipping of a specially configured fluid container, according to claim 7, wherein said predetermined thickness of said ring like member is between about ⅛ inch and about ½inch.

10. An apparatus useful as at least one of a table place mat and a lap top tray which prevents tipping of a specially configured fluid container, according to claim 1, wherein each of said first gear like member and said second gear like member are disposed at an angle of between about 20 degrees and about 65 degrees from a horizontal plane.

11. An apparatus useful as at least one of a table place mat and a lap top tray which prevents tipping of a specially configured fluid container, according to claim 1, wherein each of said first gear like member and said second gear like member are disposed at an angle of between about 25 degrees and about 35 degrees from a horizontal plane.

12. An apparatus useful as at least one of a table place mat and a lap top tray which prevents tipping of a specially configured fluid container, according to claim 1, wherein said first member and said second member are made of one of polyethylene, polypropylene, polyester and polyvinyl chloride.

13. An apparatus useful as at least one of a table place mat and a lap top tray which prevents tipping of a specially configured fluid container, according to claim 1, wherein said first member and said second member are made of polyvinyl chloride.

14. An apparatus useful as at least one of a table place mat and a lap top tray which prevents tipping of a specially configured fluid container and a specially configured food container, said at least one of such table place mat and such lap top tray comprising:

(a) a first member having a predetermined shape; and (b) a second member disposed at least one of within and on an upper surface of said first member at a first predetermined location for both retaining and preventing tipping of said specially configured fluid container; and (c) a third member disposed at least one of within and on an upper surface of said first member at a second predetermined location for both retaining and preventing tipping of said specially configured food container.

* * * * *